US006453931B1

(12) United States Patent
Traylor

(10) Patent No.: US 6,453,931 B1
(45) Date of Patent: Sep. 24, 2002

(54) COMBINATION DISHWASHER AND REVERSE OSMOSIS AIR GAB BODY

(76) Inventor: Paul L. Traylor, 2691 Richter, Suite 113, Irvine, CA (US) 92606

( * ) Notice: Subject to any disclaimer, the term of this patent is extended or adjusted under 35 U.S.C. 154(b) by 0 days.

(21) Appl. No.: 09/842,473

(22) Filed: Apr. 26, 2001

(51) Int. Cl.[7] ..... E03C 1/12
(52) U.S. Cl. ..... 137/216; 137/216.1
(58) Field of Search ..... 137/216, 216.1

(56) References Cited

U.S. PATENT DOCUMENTS

| | | | |
|---|---|---|---|
| 2,878,826 | A | 3/1959 | Dolenga |
| 3,183,923 | A | 5/1965 | Henrikson |
| 3,620,241 | A | 11/1971 | Brown |
| 3,716,143 | A | 2/1973 | Clark |
| 3,786,924 | A | 1/1974 | Huffman |
| 3,856,672 | A | 12/1974 | Boswinkle et al. |
| 3,929,149 | A | 12/1975 | Phillips |
| 3,967,638 | A | 7/1976 | Tondreau |
| 4,071,445 | A | 1/1978 | Katayama et al. |
| 4,134,419 | A | 1/1979 | Richetti |
| 4,454,891 | A | 6/1984 | Dreibelbis et al. |
| 4,646,775 | A | 3/1987 | Traylor |
| 4,771,485 | A | 9/1988 | Traylor |
| 4,812,237 | A | 3/1989 | Cawley et al. |
| 4,856,121 | A | 8/1989 | Traylor |
| 4,917,847 | A | 4/1990 | Solomon |
| 4,944,877 | A | 7/1990 | Maples |
| 4,967,784 | A | 11/1990 | Barhydt, Sr. et al. |
| 5,006,234 | A | 4/1991 | Menson et al. |
| 5,176,165 | A | 1/1993 | Traylor |
| 5,305,778 | A | 4/1994 | Traylor |
| 5,713,385 | A | 2/1998 | Traylor |

*Primary Examiner*—Gerald A. Michalsky
(74) *Attorney, Agent, or Firm*—Joseph F. McLellan

(57) ABSTRACT

A modified or retrofitted air gap body to vent the waste water discharge from a source such as a household dishwasher in such a manner that it also vents the waste water discharge from a reverse osmosis system.

23 Claims, 5 Drawing Sheets

COMBINATION DISHWASHER AND REVERSE OSMOSIS AIR GAB BODY

BACKGROUND OF THE INVENTION

1. Field of the Invention

The present invention is an air gap or air gap apparatus particularly adapted in one embodiment to vent the waste water discharge from a source such as a household dishwasher, and to simultaneously vent the waste water discharge from a reverse osmosis system.

2. Description of the Prior Art

Most plumbing codes specify that an anti-siphon or air gap be provided for venting the waste water discharge from sources such as a dishwasher. The codes typically specify that the air gap be located between the dishwasher outlet hose and the household sewage drain, or between the outlet hose and the garbage disposer if one is provided. In operation, the air gap prevents development of a vacuum that might cause waste water to be siphoned back into the dishwasher and eventually contaminate the household water supply system. This can occur when residual water in the bottom or pump portion of the dishwasher finds it way back into the water supply system.

The body of such an air gap is typically mounted to the upper surface of the rear mounting ledge of the sink top or to the upper surface of a kitchen counter next to the sink.

One or more openings in the air gap body provide communication between atmosphere and a vent chamber of the body. Since the dishwasher outlet hose communicates with an inlet to the vent chamber, the stream of waste water passing through the chamber is vented to atmosphere.

To comply with typical plumbing codes, a system which includes both a dishwasher and a reverse osmosis (RO) unit must also vent the RO discharge to prevent back siphoning of that discharge and possible contamination of the household water supply.

Installing a second, independent air gap solely for the RO system would be time consuming, expensive and unsightly because this typically requires that another hole be provided in the sink or counter top, which could cause splitting or cracking of those components. A second air gap usually also requires further modification of the existing plumbing.

For the foregoing reasons either a multipurpose air gap is needed which can be quickly and easily installed to vent both the dishwasher and the RO system, or an air gap retrofit kit is need to modify the existing air gap so that it vents more than one source of waste water.

My U.S. Pat. No. 5,713,385 (Air Gap Body For Reverse Osmosis System), issued Feb. 3, 1998, is illustrative of one means of meeting this need. The present invention is an improvement over the systems of the prior art, including that disclosed in the '385 patent.

According to the present invention, the RO drain conduit or tube is connected to the existing dishwasher air gap in a manner such that the RO drain flow is also routed through the air gap body without having to dismount it, or disturb the existing plumbing connections, or make any changes visible from above the sink or counter top. As will be seen, the modified air gap also gives the homeowner a choice between using the existing decorative cap on the air gap body or substituting a new one.

Another important feature of the present invention is that a dual purpose air gap can be installed in a new home just as easily and as inexpensively as existing air gaps, or a retrofit kit can be employed in older homes to convert its old style single purpose air gap to a dual purpose air gap.

The present air gap body is particularly adapted for rapid and easy connection to existing RO drain tubing by utilizing well known "push-on" connectors or couplers to couple the tubing to either of the popular ⅜ or ¼ inch outer diameter polyethylene drain tubing.

SUMMARY OF THE INVENTION

Thus, in accordance with the present invention, an existing dishwasher air gap body can be modified or retrofitted to simultaneously vent multiple waste water sources, such as a dishwasher and an RO system, or a new air gap body can be installed to perform these functions without further modification.

The air gap housing or body used comprises a molded, relatively hard plastic housing having an elongated and cylindrical central housing. An upper housing is threaded onto the upper end of the central housing and mounts a cap portion operative to downwardly direct the upwardly flowing waste water coming into the air gap body.

The air gap body also includes a bifurcated lower housing having a smaller diameter inlet conduit or port for receiving the dishwasher waste water, and a larger diameter outlet conduit or port for discharging the waste water to a household garbage disposer, if one is installed, or directly to the sink drain piping if there is no disposer. The foregoing structure is generally known in the prior art.

The upper housing of the air gap body includes external male threads having an approximate outside diameter of 1 ¼ inches, which is at least ⅛ inch smaller than the typical 1 ⅜ inch diameter mounting hole provided to receive the air gap body. This space or clearance is enough to enable an RO drain tube having an outside diameter of about ⅛ inch to pass upwardly into venting spaces in the air gap body for venting to atmosphere.

Use of the clearance space eliminates any need for another hole in the sink to route the RO waste water into the vented spaces. It also eliminates any need for disconnecting or rearranging any of the existing conduit connections.

According to the present invention, the existing upper nut or comparable element between the air gap housing and the upper sink surface is removed, and a special upper housing and trim ring are installed. The existing lower nut is backed off or threaded downwardly, and a special split or slotted spacer washer is placed between the lower nut and the undersurface of the sink. The split or slot in the spacer washer is large enough to allow one or more small conduits or tubes through the spacer, at least one of the tubes being the RO waste tube.

The RO waste tube is preferably made of a flexible, low friction material such as tetrafluoroethylene which can slip through small spaces. The tubing has a wall sufficiently thick that it can be curved or formed around small radii without kinking or collapsing and consequent obstruction of fluid flow.

The cap portion of the air gap body is threadably assembled onto the upper housing. It includes internal walls having deflecting surfaces which receive and downwardly direct the relatively high volume flow of dishwasher waste water that is flowing upwardly through the inlet port of the air gap body. The downwardly directed waste water passes into the upper part of the upper housing, from where it is vented to atmosphere through one or more vent openings in the cap portion and in a vent cap overlying the cap portion.

The waste tubing or conduits from the RO unit are frequently larger than the ⅛ inch outside diameter RO waste tube used in the present invention. In such cases a specially designed one-piece tubing adapter is provided for connecting the smaller ⅛ inch RO waste tube to different sizes of tubing, including the almost exclusively used ¼ and ⅜ inch sizes of tubing.

Installation of the present retrofit or modified air gap requires replacement of a minimum number of parts, all of which are readily accessible from above the sink. No substantial plumbing changes are required whatsoever.

Other objects and features of the present invention will become apparent from the following more detailed description taken in conjunction with the accompanying drawings.

DESCRIPTION OF THE PREFERRED EMBODIMENTS

Figure 1:
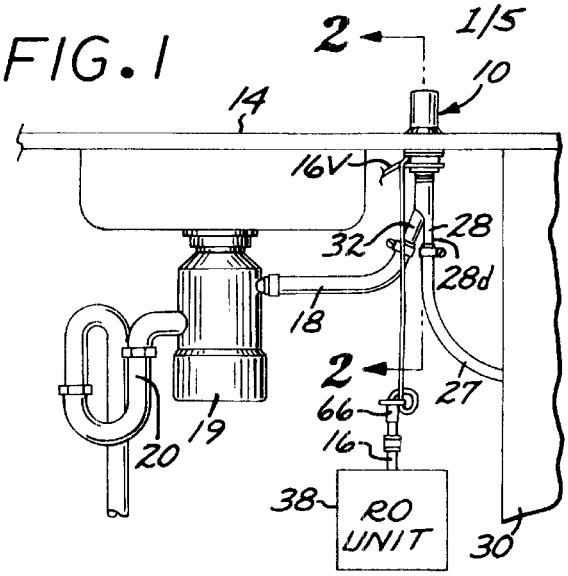
FIG. 1 is a front elevation of one embodiment of an air gap, air gap apparatus or air gap unit, according to the present invention, as the air gap would be used in combination with a dishwasher and a garbage disposer.

Referring now to the drawings, and particularly to FIG. 1, an air gap 10 is illustrated which utilizes a known air gap body 15 molded of plastic material, and having an inlet conduit port 28, an outlet port 32, and an elongated, vertically extending central housing 22. The housing 22 is externally threaded at its upper extremity and preferably has an outside diameter of approximately 1 ¼ inches. The air gap body 15 is made of generally rigid material, but is bendable or deformable to a limited extent so that the round shape of the inlet port 28 can be squeezed into an oval shape, and the port 28 itself deflected laterally, as will be seen.

The internally threaded bottom of an upper housing 11 is threaded onto the threaded upper extremity of the central housing 22. The upper extremity of the upper housing is also externally threaded to mount an internally threaded cap portion 12. The cap portion, in turn, mounts a protective or decorative vent cap 24 having one or more vent openings 37.

The air gap body 15 is illustrated as it would appear when installed in a sink mounting hole 17 drilled or otherwise formed in the rear of a usual and conventional kitchen sink top 14.

Waste water from one or more sources, such as a dishwasher 30 and an RO unit 38, flow upwardly through the air gap inlet port 28. The central housing 22, upper housing 11, and cap portion 12 are operative to receive this flow, and redirect it downwardly so that it passes through an air gap vent chamber or space which is vented to the outside atmosphere through an opening or openings in the vent cap 24.

The downwardly flowing waste water passes out of the outlet port 32 and either into the discharge hose 18 of a garbage disposer 19, if one is present, or if not, directly into a household drain pipe 20.

Part of the waste water flowing into the air gap body comes from the RO unit 38 through flexible tubing, which can be ⅛ inch tubing but often is ¼ or ⅜ inch in outside diameter. As will be seen, a suitable inlet port 28*d*, FIG. 16, may be provided to accept all three of these sizes for connection to the RO waste water tube 16 which extends upwardly to the air gap vent chamber.

The tube 16 is preferably made of tetrafluoroethylene material, with the proper dimensions being determined through trial and error.

A preferred form of such material is marketed by McMaster-Carr under the designation FEP 52355K1 1. It is ⅛ inch in outside diameter (OD), a wall thickness of approximately 1/32 inch. It is identified as being made of "TEFLON" material (a registered trademark).

The foregoing dimensions are merely exemplary and can be adjusted to suit the requirements of particular applications.

The preferred tube 16 is particularly suited for use with the present invention because of its small size and slippery or low friction character. This enables it to be passed through small openings, and bent or formed around relatively small radii without kinking. Any kinking would have the undesirable effect of obstructing fluid flow.

Figure 2:
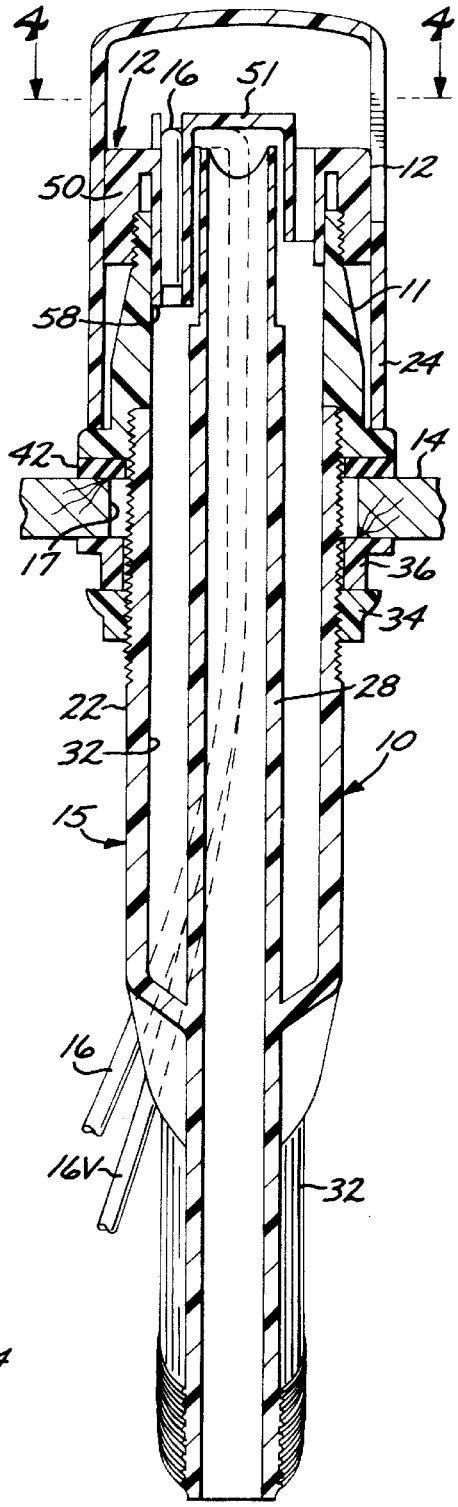
FIG. 2 is an enlarged view of the air gap, taken along line 2—2 of FIG. 1.
Figure 3:
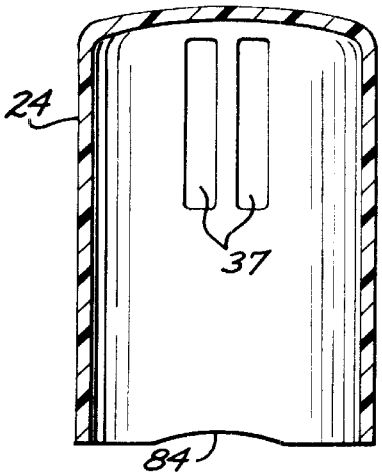
FIG. 3 is a longitudinal cross section of a protective or decorative cap.

As seen in FIG. 2, the air gap body 15 of the prior art comprises a vertically extending, generally elongated molded structure having a cylindrical mid portion or central housing 22 that is preferably about 1 ¼ inches in diameter, and externally threaded at its upper portion.

According to the present invention, the upper portion of the housing 22 mounts an internally threaded upper housing 11 to which is fitted the cap portion 12. A protective vent cap 24 having one or more vent openings 37 is fitted over the cap portion 12 in engagement with the upper housing 11, as illustrated. The vent opening or openings 37 are configured to vent the cap 24 and the interior of the air gap body 15 to the outside atmosphere.

The central housing 22 extends downwardly and is integral with the elongated smaller diameter, vertically oriented inlet port 28. The lower end of the port 28 receives waste water from a dishwasher 30 through a conduit 27, as seen in FIG. 1. The port 28 extends up through the central housing 22, and the upper end of the port 28 projects above the central housing 22 for discharge of the waste water into the cap portion 12.

The difference in diameters between the inner wall of the central housing 22 and the outer wall of the inlet port 28 defines a generally annular space adapted to receive waste water flowing downwardly from the cap portion 12. At its bottom this annular space empties into the outlet port 32, which is also molded integral with the air gap body.

The outlet port 32 angles or slants outwardly and downwardly from the annular space between the central housing 22 and the inlet port 28, and typically is connected to a soft rubber garbage disposer hose 18 or, if there is no disposer, to the sink drain line (not illustrated) for eventual emptying into the household drain pipe 20.

If an air gap body 15 has previously been installed, and it is desired to retrofit it according to the present invention, the existing air gap body is left as it is, with its upper extremity extending upwardly to a position above the mounting hole 17 in the sink top 14. Its connections to the ports 28 and 32 are not changed.

Figure 17:
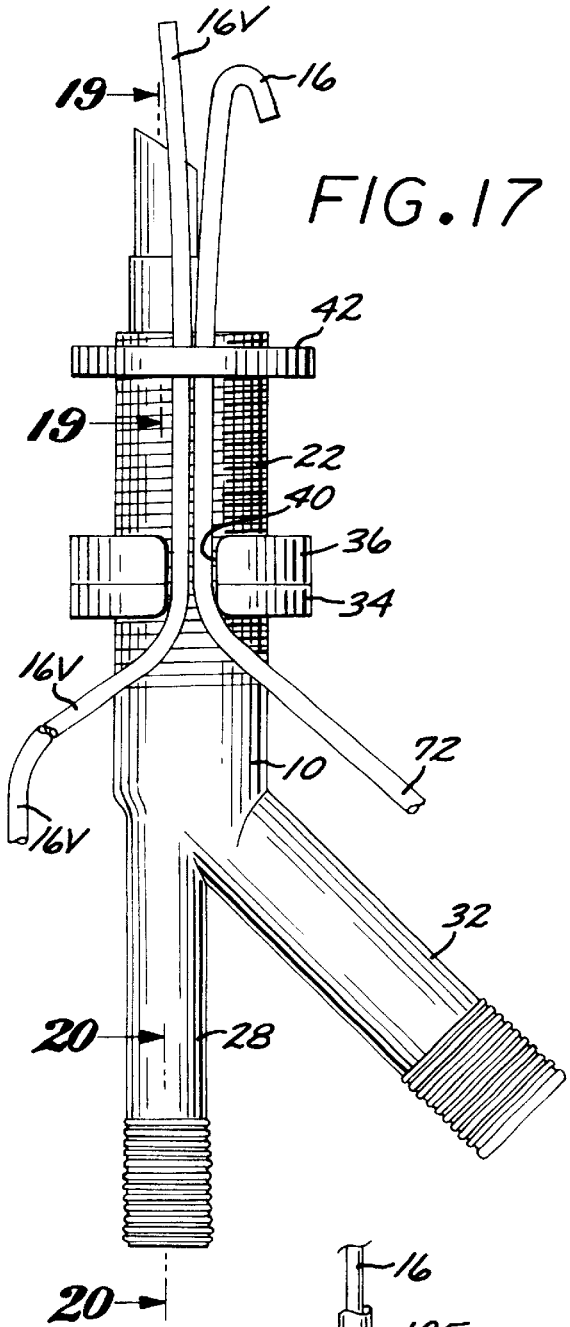
FIG. 17 is a front elevational view of the central housing.

The lower extremity of the existing central housing threadably mounts a bottom nut 34, as best seen in FIGS. 2 and 17. This bottom nut 34 will need to be backed off or threaded downwardly to enable the split spacer washer 36 of the present invention to be laterally positioned upon the air gap central housing, between the bottom nut 34 and the undersurface of the sink top 14.

However, if the existing air gap body is to be replaced, the vent cap 24 and upper housing 11 are removed after disconnection of conduits associated with the ports 28 and 32. The upper extremity of the new central housing 22 is projected downwardly through the existing sink mounting hole 17. The bottom nut 34 is next threaded off the original central housing 22 and rethreaded or installed on the new housing 22, or discarded and replaced with a new nut 34 if the old nut is corroded or is otherwise unacceptable.

After installation of the nut 34, it is threaded onto the lowermost threaded portion of the new housing 22, and the upper extremity of the new housing 22 is projected upwardly through the sink mounting hole 17. This leaves enough space for the split washer 36 to snap fit between the bottom nut 34 and the underside of the sink 14.

A washer or trim ring 42 is threaded into the position illustrated for securing the new housing 22 in place. The upper housing 11 and cap portion 12 are next adjusted into proper position, as illustrated in FIG. 2. The new conduit connections are then made at ports 28 and 32.

The split spacer washer 36 is made of plastic material sufficiently resilient that it can be temporarily deformed from its normal circular shape in order to widen the split 40 in the washer 36 for snapping onto the body 15. The resilience of the washer material biases the washer 36 in snug relation to the air gap body 15.

The slot 40 also provides a space through which the waste water tube 16 and, if desired, an additional tube or tubes of similar size, such as a vent tube 16 v, can be disposed upwardly toward the upper housing 11 and cap portion 12 adjacent the male threads of the central housing 22.

The 1 ¼ inch OD of the threaded upper extremity of the central housing 22 projects upwardly through the usual 1 ⅜ inch sink mounting hole 17 in the sink top 14, while leaving enough room for the tube 16 to easily pass between the wall of the mounting hole 17 and the central housing 22. This makes it unnecessary to drill another hole or enlarge the existing hole to accommodate the tube 16.

The resilient and waterproof trim ring 42 is tightened in place over the upper threaded extremity of the central housing 22 to complete the installation of the upper housing 11.

Figure 9:
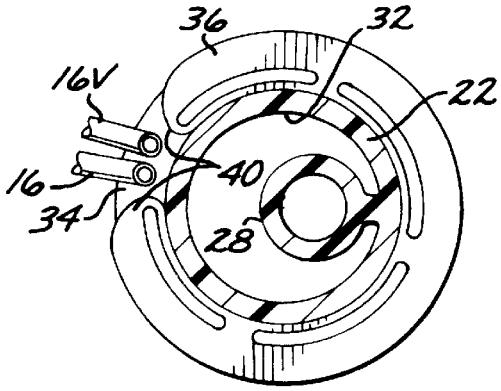
FIG. 9 is a view taken along the line 9—9 of FIG. 5.
Figure 10:
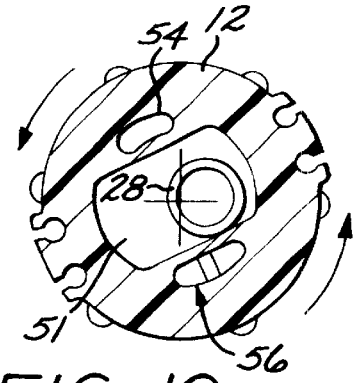
FIGS. 10, 11 and 12 are views similar to the view of FIG. 6, but illustrating successive positions of rotation of the cap portion.
Figure 11:
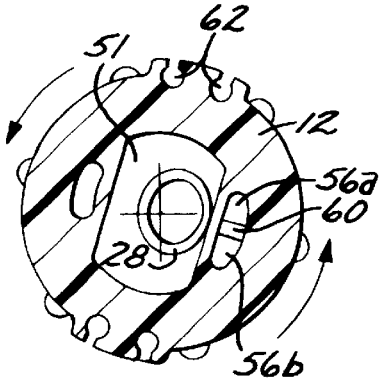
Figure 12:
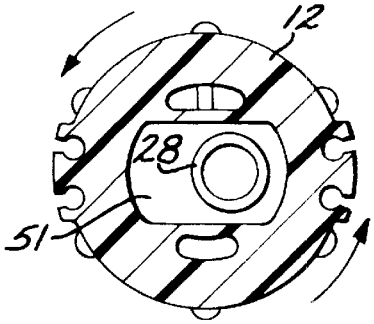
Figure 18:
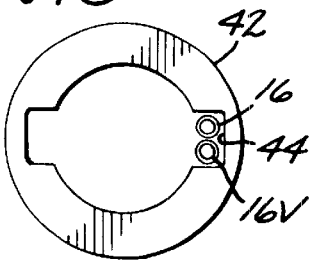
FIG. 18 is an enlarged plan view of the trim ring mounted to the upper extremity of the central housing.

The installer next selects the most easily accessible hole or pair of holes 45 in the base flange of housing 11 for receipt of the ⅛ inch tubing 16. The installer next rotates the components slightly to vertically align the hole or holes with one of the diametrically oppositely disposed washer slots 44 of the trim ring 42, as best seen in FIG. 18, and with the slot 40 of the spacer washer 36, as seen in FIG. 9. The bottom nut 34 is then tightened to secure the air gap assembly in position.

The new or replacement trim ring or washer 42 provides a waterproof seal between the upper surface of the sink top 14 and the bottom mounting flange of the upper housing 11. Either of the slots 44 of the trim washer 42 can be aligned with the three holes. Each slot 44 is large enough to accommodate the tube 16 and at least one additional tube, such as the vent tube 16 v, if desired.

The two pairs of openings 45 in housing 11 align with corresponding pairs of vertically elongated grooves 46 provided in the lower part of the housing 11. Any of the grooves 46 thus would be positioned to receive and seat an RO tube 16 coming up through a hole 45.

Figure 6:
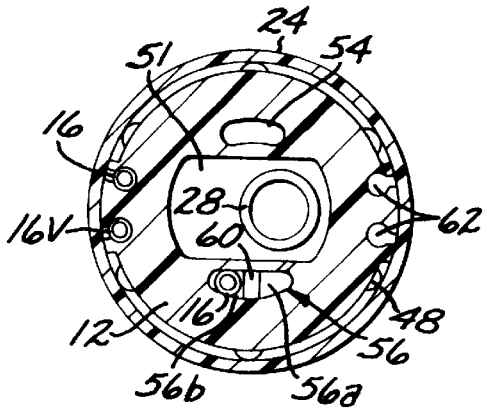
FIG. 6 is a view taken along line 6—6 of FIG. 5.
Figure 7:
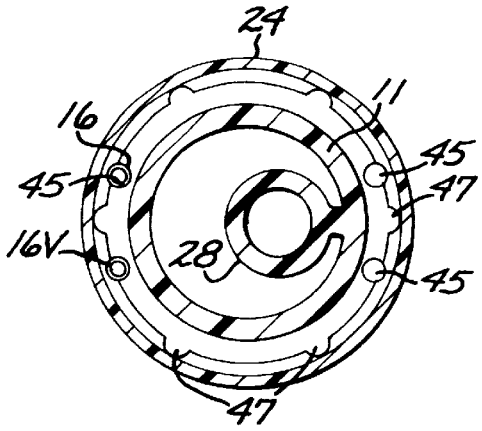
FIG. 7 is a view taken along line 7—7 of FIG. 5.
Figure 8:
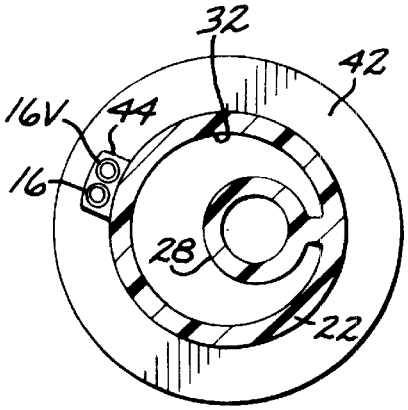
FIG. 8 is a view taken along line 8—8 of FIG. 5.

The upper housing 11 also includes a plurality of vertically oriented, circumferentially spaced apart ribs 47 adjacent its base flange. The ribs 47 are adapted to snugly engage the inner surface of the lower extremity of the vent cap 24 to removably hold the vent cap centered and in its fully seated position. The cap portion 12 also includes special grooves or seats 62 for receiving and securing the tube 16 in position, as seen in FIG. 6.

As seen in FIGS. 5 and 10–12, the cap portion 12 further includes cylindrical skirt 50 and an integral cylindrical central section 51 of lesser diameter such that the inner surface of the skirt 50 and the outer surface of the central section 51 form an annular space adapted to threadably receive the upper extremity of the upper housing 11.

The section 51 also includes parallel vertical side walls integral with and extending downwardly from a horizontal or concave upper wall of the section 51. The inner surfaces of the upper wall and the side walls constitute surfaces for receiving, gathering and downwardly directing waste water that is discharged from the upper end of the inlet conduit 32.

One side wall defines an internal space 56 which is split into two spaces **56*a* and 56*b* by a vertical partition 60. The space 56*b* is adapted to receive the RO waste water tube 16, while the space 56*a* is available for receipt of a vent tube 16 or the like as seen in FIG. 18**, which is advantageous for certain applications.

The side defining the space 56 extends to a point well below the stream of dishwasher water entering and partially filling the interior of the cap portion This enables the RO waste water to be discharged and vented through the space 56 without any danger, should a back siphoning or suction occur in the tube 16, that dishwasher waste water would be drawn into the tube 16 and contaminate the household water system.

The interior of the cap through which the dishwasher waste water flow is vented primarily through the vent 54.

Both vents 54 and 56 are in communication with the interior of the upper housing 11 and the atmosphere through the vents 37 of the decorative vent cap 24.

The optimum degree of downward projection of the walls and the projection 58 defining the vents 54 and 56 to produce maximum water flow and venting is determined through laboratory tests.

Figure 4:
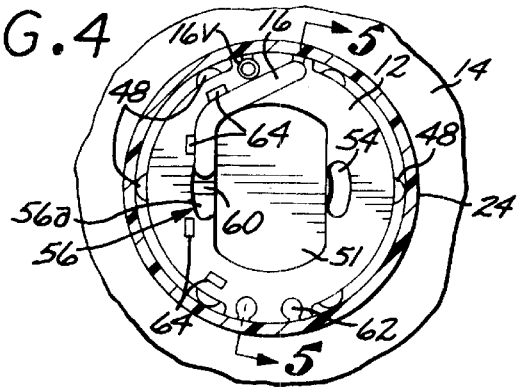
FIG. 4 a view taken along line 4—4 of FIG. 2.

The tube 16 is maintained in position by seating it within one of two pairs of adjacent, vertically extending grooves 62, as best seen in FIG. 4. The grooves 62 are located in the cap portion 12 on opposite sides of the circumferential skirt 50, each of the pairs of grooves 62 being oriented approximately 90 degrees from the passages 54 and 56, respectively.

Each pair of grooves 62 defines a seat having a narrow entry through which the flexible and resilient waste water tube 16 can be pressed. The tube is slightly compressed on passage through the narrow entry, but upon seating within a groove 62 of the first pair of grooves, the tube 16 resiliently expands so that it is held in position within the groove, as seen in FIG. 6.

The second pair of grooves 62 operates in a similar manner. One of each of the second pair of grooves 62 is also adapted to receive the tube 16, as best seen in FIG. 6.

On final tightening of the cap portion 12, as will be described, the groove 62 which is most closely aligned with the upwardly extending tube 16 receives the tube.

The upwardly extending tube 16 is trained or deformed to lie horizontally between two sets of confronting retainer tabs 64 that are arranged on the top of the cap portion 12 to define a curving path for the tube 16. The tabs 64 are spaced apart to define a passage narrow enough to retain the tube when the tube is pressed between them. The passage or curving path leads to the vent chamber 56.

As will be apparent, proper orientation of the tube 16 is achieved by approximate alignment of the holes and grooves in the cap portion 12 and in the upper housing 11 through relative rotation of the components that define the holes and grooves.

Each side of the partition wall 60 at its bottom edge includes locating flanges (not shown) which project outwardly for engagement with the downwardly extending end of the tube 16 inserted through vent spaces 56*a* or 56*b*, as the case may be. This engagement enables the tube end to be located a predetermined optimal distance above the lower end of the projection 58, thereby satisfying applicable plumbing codes. The flange also prevents the tube 16 from being inserted too deeply.

The partition 60 is also adapted to engage and press against the tube 16 to properly orient it relative to the vent chamber, and constrain it from being moved out of its proper position within the vent chamber.

Figure 19:
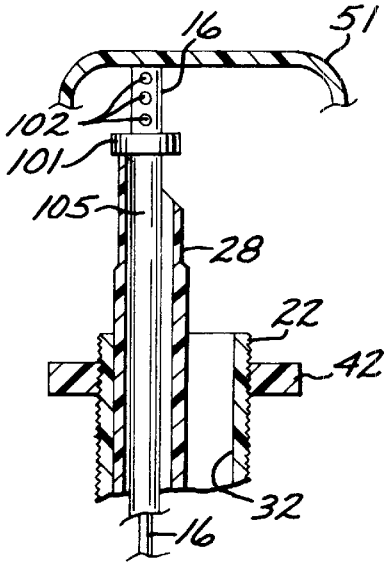
FIG. 19 is a view taken along the line 19—19 of FIG. 17.

If a vent tube 16 v is to be used, it should be about the same size as the tube 11, and extend upwardly from below the sink top 14, parallel to the tube 16, and up to the top of the cap portion 12, as seen in FIGS. 17–19. This locates the upper end of the vent tube above the actual flood level (F/L) of the air gap 10. The vent tube is held in this position by snap fitting it partially or completely through one of the grooves 62.

The configuration and location of the upper or discharge end of the inlet conduit 28 may vary according to the requirements of a particular application.

Figure 5:
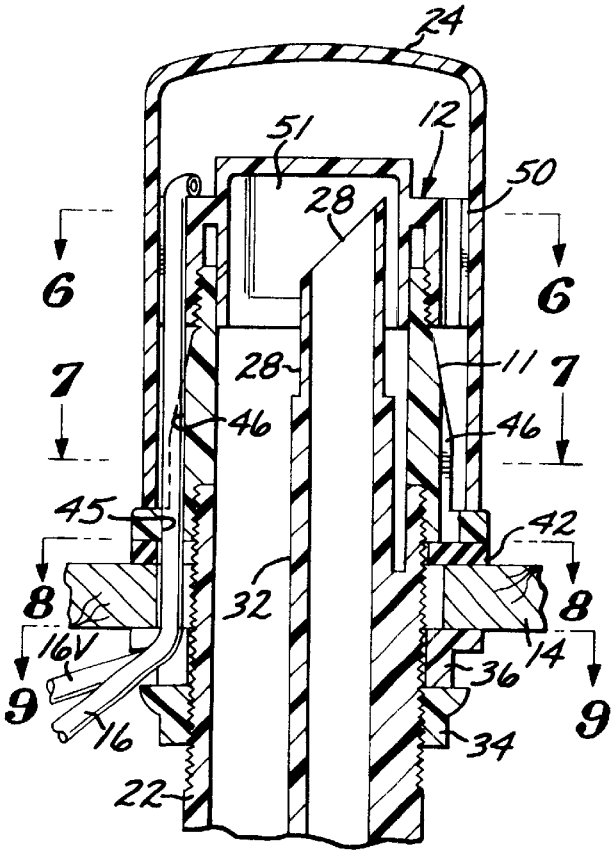
FIG. 5 is a view taken along line 5—5 of FIG. 4.

In the embodiment illustrated in FIG. 5, the upper end of the inlet conduit 28 is cut at about a 45 degree angle. The greater the angle, the more directly the underside of the central section 51 is struck by the stream of water, which affects its rate of flow into the vent chamber.

Alternatively, the top of the conduit 28 can be cut off along a horizontal axis and arranged to engage the underside of the central section. If such a structure were employed, a plurality of outlet openings 102 would provided in the conduit 28, as seen in FIG. 19. These could be formed in any suitable way, as by drilling or by cutting slits in place of the drilled holes.

The embodiment of FIG. 19 also includes a tubing clamp 101 which can be applied after the tube 16 is brought up through the inlet conduit 28. The clamp 101 is crimped onto the tube and is engageable with the upper end of the conduit 28 to prevent the tube 16 from being inadvertently pulled downwardly and thereby removed through the conduit 28.

If the air gap 10 is to be associated with an already installed dishwasher air gap, the RO tube 16 is routed through the existing air gap to achieve proper venting to comply with plumbing codes. However, none of the existing plumbing has to be disconnected, enabling retrofit of the existing air gap quickly, easily and cheaply, without any need to use a brand new second air gap. to handle venting of the RO waste water flow in addition to venting of the waste water flowing through the existing air gap.

Installation of the present air gap as new equipment in replacement of an old air gap is preferably done in a particular sequence. More particularly, the existing components of the old air gap are separated from the air gap body 15, and inlet and outlet conduit ports 28 and 32 are also disconnected and discarded. If desired, some parts can be reused, such as the existing bottom nut 34 and vent cap 24.

The new air gap with the new nut 34 installed is next upwardly projected through the mounting hole 17. Next, the notched trim ring 42 is mounted onto the upper extremity of the upper housing 16.

Next, the upper housing 11 is threaded onto the upper end of the air gap as far as the threads permit. If the RO waste water tube 16 is to be used, the spacer washer 36 is installed over the housing and nut 34, and upwardly against the spacer washer 36, but not fully tightened. Next, the slots or openings in the trim ring 42 and in the spacer washer 36 are vertically aligned, and the bottom nut 34 is then fully tightened.

The inlet conduit 27 and the discharge hose 18 are then pushed over the barbs or ridges on the inlet port 28 and the outlet port 32, respectively, and their position is maintained by suitable, reusable clamps, as seen in FIG. 1.

On the other hand, if the existing air gap body is used, it will be retrofitted. The existing vent or decorative cap 24 is removed and, if desired, later replaced with a new vent cap 24.

Once installed, the cap portion 12 is prevented by the tube 16 from rotating and becoming unthreaded. Rotation is also prevented by the non-central location of the inlet port 28 in the central section 51, as best seen in FIG. 5. This location causes the port 28 to engage the inner walls of the section 51 once optimum alignment is achieved.

The tube 16 is installed by projecting the discharge end of the tube downwardly into passage 56*a* until the tube engages the wall 60. As previously explained, the opposite extremity of the tube 16 is next oriented along the curving path defined by the retainer tabs 64. Following this the tube 16 is snapped into an adjacent groove 62 and through a hole 45 most nearly aligned with the groove 62. Vertical alignment of the notch and slot allow the tube 16 to project downwardly through the notch in washer 42, alongside the housing 15, and then outwardly through the slot 40 of spacer washer 36.

Figure 13:
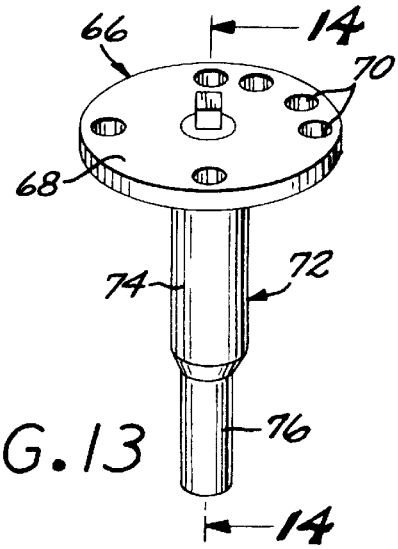
FIG. 13 is a perspective view of a special tubing adapter.
Figure 14:
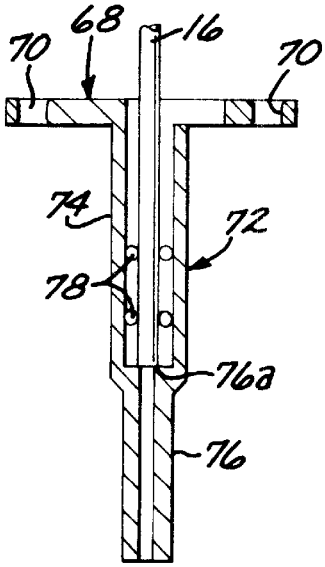
FIG. 14 is a view taken along the line 14—14 of FIG. 13.
Figure 15:
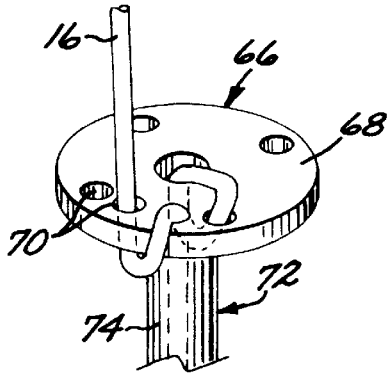
FIG. 15 is a partial perspective view similar to FIG. 13, but illustrating the disposition of an RO tube through the special adapter to prevent the tube from being pulled out of the adapter.

The tube 16 is extended downwardly into a tubing adapter 66, as best seen in FIGS. 13, 14 and 15. The tube 16 bottoms against an internal shoulder 76*a* in the lower shank 72 of the adapter 66. O-rings 78 provide a sealing interface internally of the lower shank 72, as best seen in FIG. 14.

The vent cap 24 is frictionally held in position by pressing it downwardly over a plurality of ribs 47 formed in the upper housing 11 until it engages the base flange of the upper housing 11.

A cutout portion 84 is provided in the cap 24 to allow any condensation in the cap 24 to escape onto the sink top 14, the cap 24 preferably being rotated to place the portion 84 rearwardly, out of the sight of the homeowner.

The tubing adapter 66 is designed to couple the RO tubing 16 to different sizes of associated tubes or conduits, as seen in FIGS. 13–15. The adapter 66 comprises an upper flange 68 having a plurality of circumferentially arranged openings 70. The bore of the lower shank 72 opens into a larger diameter bore in an upper shank portion 74.

The downwardly extending RO tube 16 can be connected to various sizes of tubing and securely held in position preventing its separation from larger tubing. To accomplish this is, the tube 16 is trained through one of the openings 70 and then reversely formed so that it extends upwardly through a hole 70, and then horizontally and downwardly through another hole 70, again upwardly through an adjacent hole 70, and finally downwardly into the bore of the upper portion 74.

A pair of O-rings 78 are preferably mounted on the tube 16 for engagement with the walls of the bore of the upper portion. This restrains the slick or low friction tubing from being pulled out of the adapter 66. To further insure against separation of the tube 16 from its position within the air gap chamber, as seen in FIG. 19, a collar 101 is crimped onto the tube 16 in engagement with the upper end of the inlet port 28.

If the RO unit tubing is relatively large in diameter, such as ¼ inch, then any suitable commercial quick connect coupling (not shown in detail) can be used to couple the tubing extending from the RO unit on one side, to the upper portion 74 of tubing adapter 66 on the other side. If the extended tubing is ¼ inch, then a commercial ¼ inch quick connect coupling is used. It couples onto lower portion 76. Some commercial ⅜ inch couplings are not deep enough to fully accept adapter 66. If this is the case, then the lower portion 76 is cut off, as seen in FIG. 14, allowing upper portion 74 to be fully inserted into a ⅜ inch quick connect fitting.

The foregoing structure in conjunction with one or more O-rings 78 provides a good pressure seal and resistance to axial separation from the adapter 66. In addition, the tortuous path defined for the tube 16 by the openings 70 in the adapter makes inadvertent separation of the tube 16 from the adapter 66 very unlikely This arrangement eliminates any need for adhesives or keepers (not shown) to physically clamp or positively fix the tube 16 in position. The absence of adhesives allows the tube 16 to be deliberately manipulated to separate it from the adapter 66 if desired In a further embodiment of the invention the inlet port 28 includes a central bore receiving an RO tube 105 which is somewhat larger than the typical ⅛ inch size. It is disposed within a counterbore 104 within which are received several O-rings 108 which tend to constrain the tube 105 from separation from the inlet port 28. With this arrangement a smaller diameter RO tube 16 can be forced through the larger diameter tubing.

Figure 21:
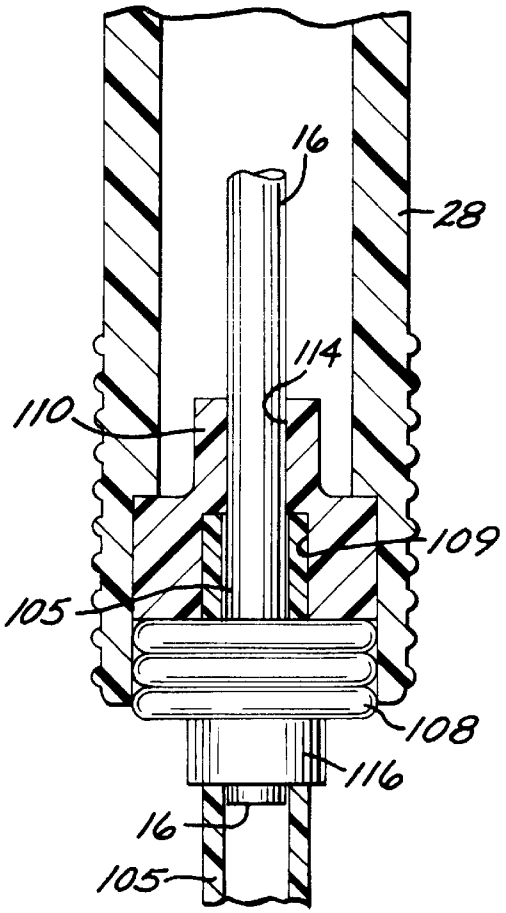
FIG. 21 is an enlarged longitudinal cross sectional view of another form of tubing adapter.

In another embodiment of the invention, the RO tube 105 from the RO unit is also somewhat larger than the typical ⅛" size. It is disposed within the counterbore 109 of a tubing adapter 110, as seen in FIG. 21. The adapter 110 is press fitted within the open end of the inlet conduit 28, and it includes an adjacent smaller central bore 114, which defines a shoulder against which the end of the larger tube 105 abuts.

The end of the inlet conduit 28 also includes a counterbore which provides a shoulder which serves as a stop for the adapter 110 when it is pressed into the conduit 28 in close and snug relation. This expands the flexible material at the end of the inlet conduit 28 so that it tightly engages and restrains the adapter 110 from separation from the conduit 28. The primary constraint against such separation is a plurality of O-rings 108 located between the end of the adapter 110 and the inner surface of the end of the conduit 28.

The wall thickness of the end portion of the conduit 28 can be increased, or provided with an enlarged diameter portion or collar (not shown) to enable expansion of the end portion by the inserted adapter 110 without cracking or structural failure.

The typical smaller diameter tube 16, which is normally used in air gaps, is pushed into the inner end of the tube 105, tubes 16 and 105 being secured together against relative longitudinal movement by a crimping fitting 116.

In this manner the adapter 110 quickly and easily accepts the larger tube 105 and secures it to the smaller tube 16. The tube 16 projects upwardly through the inlet port 28 for communication with the air gap venting space which is open to atmosphere.

Figure 20:
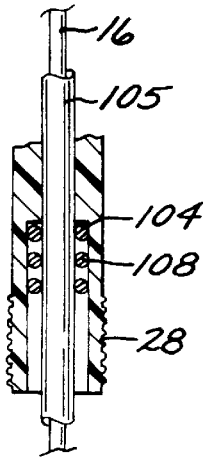
FIG. 20 is an enlarged vertical cross sectional view taken along the line 20—20 of FIG. 17.

A related embodiment is partially illustrated in FIG. 20 in which the larger tube 105 is held within a bore 108 of the inlet port 28 by a plurality of O-rings 104. In this embodiment the RO tube 16 coming from the RO unit is ⅛" in diameter and projects upwardly through the tube 105. As seen in FIG. 19, the tube 16 engages the underside of the air gap body 15, as illustrated, and the tube 16 is prevented from being withdrawn from the tube 105 by a crimping fitting 101.

Figure 16:
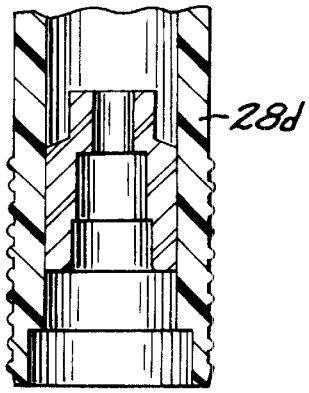
FIG. 16 is a detail vertical cross sectional view particularly illustrating a modified inlet port adapted to accept tubing of various sizes.
Figure 22:
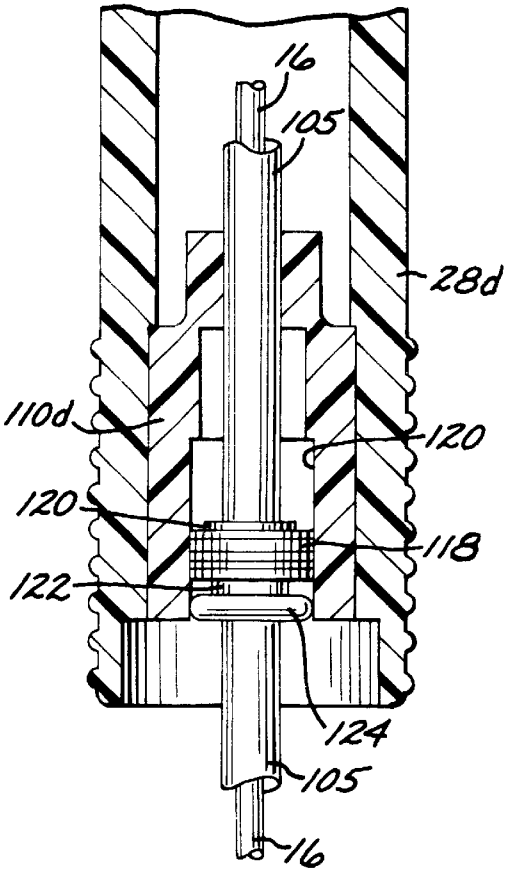
FIG. 22 is a view similar to FIG. 21, but showing yet another form of tubing adapter.

Yet other embodiments are illustrated in FIGS. 16 and 22. In FIG. 16 a modified inlet port 28*d* includes a pair of successively smaller diameter counterbores and the adapter pressed into the central bore of the inlet port also has counterbores of decreasing diameters to accept in press fit relation various sizes of tubing. In the embodiment of FIG. 22 the tube 105 is disposed through what is known in the prior art as a "John Guest Half Cartridge".

The cartridge is characterized by a central cylindrical section 118 which is press fit within a bore 120 of the adapter 110*d*. An inner diametrically expansible section is disposed within the section 118, surrounds the tube 105, and includes opposite transverse faces 120 and 122 which engage complemental transverse opposite faces of the section 118. The arrangement holds the cartridge within the bore 120, and an O-ring 124 is provided to establish a fluid tight fit.

The feature of such a John Guest fitting used in the arrangement illustrated is the ability to receive tubes 105 of progressively larger sizes, such as ¼ and ⅜", by simply snapping them into the successive bores illustrated. Thus, the adapter 110*d* can be marketed to handle various sizes of RO waste tubes simply by incorporating in the fitting a plurality of bores, each appropriately sized to receive a complementally sized John Guest fitting.

From the foregoing it will be seen that the present invention provides an easy means for installing a completely new air gap or for quickly and economically retrofitting an existing prior art air gap by replacing the elements described above. With either a new or retrofit installation, RO waste water from both a dishwasher and a reverse osmosis unit can be vented.

While preferred forms of the invention have been illustrated and described, it will be apparent that various modifications and changes can be made without departing from the spirit and scope of the invention.

What is claimed is:

1. An air gap apparatus comprising:

a vertically oriented inlet port having a top and adapted for carrying waste water from a waste water source to the top of the inlet port;

an air gap body including a hollow, vertically elongated central housing internally receiving the inlet port to define an internal discharge chamber, the central housing being adapted to be located within a mounting hole in a sink, the central housing including an elongated, externally threaded lower portion for extension below the sink, the lower portion being merged at its lower extremity with the inlet port, the central housing further including an externally threaded upper portion for extension above the sink, the inner walls of the central housing above the lower portion being spaced from the inlet port to define a generally annular discharge chamber, an upper housing threaded onto the upper portion, the upper housing having sets of vertically oriented grooves and a base flange provided with sets of complemental mounting holes, each set of the grooves being adapted for alignment with a set of the grooves for receiving and holding a waste water tube; and a hollow cap portion threaded onto the upper housing, and including a generally cylindrical wall, a pair of generally vertical side walls extending inwardly from the outer surfaces of the side walls defining a first vertical vent passage having a lower extremity located adjacent the discharge chamber, and a second vertical vent passage having a lower extremity extending downwardly into the discharge chamber, and a generally horizontal upper wall extending between the upper ends of the side walls and defining with the side wall surfaces a redirecting chamber for surrounding, intercepting and downwardly directing waste water from the inlet port into the discharge chamber.

2. Air gap apparatus according to claim 1 and including an RO waste water source and a waste water tube extending from the RO waste water source, the waste water tube being made of bendable, resilient low friction material for slidable receipt within a set of the holes and an aligned set of the grooves.

3. Air gap apparatus according to claim 2 wherein the material is tetrafluoroethylene.

4. Air gap apparatus according to claim 1 wherein the waste water tube has an outside diameter of approximately ⅛ inch and a wall thickness of approximately 1/32 inch.

5. An air gap apparatus according to claim 1 wherein at least one of the vent passages is adapted to receive a waste water tube for accepting waste flow from another waste source for emptying such waste flow into the discharge chamber.

6. Air gap apparatus comprising:

a hollow vertically oriented central housing having a threaded upper extremity adapted to be located within a mounting hole in a sink top;

a hollow vertically oriented upper housing mounted to the central housing;

a hollow cap portion mounted to the upper housing and having water deflection wall means;

a hollow cap fitted over the cap portion and venting the hollow interiors of the central housing, upper housing, cap portion and cap to atmosphere;

an outlet port in communication with the interiors;

an elongated inlet port extending upwardly through the hollow interiors and having a bore adapted to receive waste water from a first source, the inlet port having an upper extremity adjacent the water deflection wall means whereby waste water flowing upwardly through the inlet port and out of the upper extremity is deflected downwardly through the hollow interiors and into the outlet port; the inlet port having a lower extremity characterized by a central bore and counterbore means in the lower extremity defining a plurality of counterbores of different diameters for accepting a waste water tube in a selected one of the counterbores;

a first waste water tube for receiving waste water from a second source; and tube support means directing and guiding the waste water tube into association with the upper housing and cap portion for reversely directing the waste water tube for discharging the waste water into the interiors for passage into the outlet port.

7. Air gap apparatus according to claim 6 and including a quick disconnect fitting adapted for association with a selected one of the counterbores to hold the first waste water tube in position, and further including fluid seal means providing a fluid seal between the quick disconnect fitting and the selected one of the counterbores.

8. An air gap apparatus according to claim 7 wherein a utility tube is coaxially disposed upwardly through the first waste water tube for selectively accepting water from a further source of waste water and for venting the further source of waste water to atmosphere.

9. Air gap apparatus comprising:

a hollow vertically oriented central housing having a threaded upper extremity adapted to be located within a mounting hole in a sink top;

a hollow vertically oriented upper housing mounted to the central housing;

a hollow cap portion mounted to the upper housing and having water deflection wall means;

a hollow cap fitted over the cap portion and venting the hollow interiors of the central housing, upper housing, cap portion and cap to atmosphere;

an outlet port in communication with the interiors;

an elongated inlet port extending upwardly through the hollow interiors and having a bore adapted to receive waste water from a first source, the inlet port having an upper extremity adjacent the water deflection wall means whereby waste water flowing upwardly through the inlet port and out of the upper extremity is deflected downwardly through the hollow interiors and into the outlet port; and wherein the inlet port extends upwardly, close enough to the water deflection wall means that upon each 180° rotation of the cap portion the upper end of the inlet port is resiliently deformed relative to the wall means, thereby altering the direction of the path of waste water relative to the wall means.

10. Air gap apparatus according to claim 9 wherein the inlet port is of circular cross section and sufficiently resilient and capable of precise placement relative to the wall means that the inlet port is adapted to be resiliently deformed into an oval shape to reduce the pressure drop and thereby reduce the noise generation accompanying the flow of the waste water relative to the wall means at higher flow rates.

11. An air gap body comprising:

a hollow vertically oriented central housing having a threaded upper extremity adapted to be located within a mounting hole in a sink top;

a hollow vertically oriented upper housing mounted to the central housing and having a lower portion;

a hollow cap portion mounted to the upper housing and having a water deflection wall;

a hollow cap fitted over the cap portion and venting the hollow interiors of the central housing, upper housing, cap portion and cap to atmosphere;

an outlet port in communication with the interiors;

an elongated inlet port extending upwardly through such hollow interiors and adapted to receive waste water from a first source, the inlet port having an upper extremity adjacent the water deflection wall whereby waste water flowing upwardly through the inlet port and out of the upper extremity is deflected downwardly by the water deflection wall through the hollow interiors and into the outlet port;

a waste water tube for receiving waste water from a second source;

tube support means directing and guiding the waste water tube into association with the upper housing and cap portion for reversely directing the waste water tube for discharging the waste water into the hollow interiors for passage into the outlet port;

a bottom nut for threaded mounting to the threaded upper extremity of the central housing below the sink top; and wherein the lower end of the inlet port includes a first counterbore, a tubing adapter press fitted within the inner extremity of the first counterbore, the tubing adapter having a central bore for receiving a relatively small diameter tubing, the lower end of the tubing adapter having a counterbore adapted to receive a relatively large diameter tubing which is tightly engaged by the tubing adapter when the tubing adapter is press fitted into position; and O-ring means located between the tubing adapter and the inner surface of the inlet port, and constraining the tubing adapter from separation from the inlet port.

12. An air gap body according to claim 11 wherein the tube support means is defined in part by an opening in the lower portion of the upper housing, and by a vertically oriented first groove extending upwardly from the opening to closely receive and retain any waste tube extending upwardly from the opening in the lower portion of the upper housing.

13. Air gap body according to claim 12 wherein the tube support means is further defined by a vertically oriented second groove in the cap portion in approximate alignment with the first groove, the second groove having a narrow throat through which the waste water tube can be press fitted for snug retention in the second groove.

14. Air gap body according to claim 13 wherein the cap portion is circumferentially rotatable to align the second groove with the first groove, whereby the waste water tube can be extended through both the first and second grooves and reversely formed for downward disposition.

15. An air gap body according to claim 11 wherein the cap portion includes a vertically directed passage having a wall dividing the passage into two portions, one to receive the waste tube, and the other to provide venting to atmosphere.

16. An air gap body according to claim 11 wherein the first source is a household dishwasher, and the second source is a reverse osmosis unit, whereby the air gap body is adapted to provide venting to atmosphere of the waste flows from both the first and second sources.

17. An air gap body according to claim 11 wherein the waste tube is made of approximately ⅛ inch outside diameter tetrafluoroethylene tubing whereby the tube can be slipped through small openings and formed around sharp bends without kinking and consequent interruptions of the flow of the waste water through the waste water tube.

18. Air gap body according to claim 17 and including a resilient circular split spacer washer having an expansible slot enabling forcible lateral positioning of the spacer washer upon the threaded extremity and subsequent removal of the split spacer washer from the threaded upper extremity, the slot being large enough for passage of the waste water tube through it.

19. An air gap body according to claim 11 wherein the extremity of the central housing is threaded and has an outside diameter less than the diameter of a mounting hole in a sink top whereby the upper extremity is adapted to extend upwardly through the hole with sufficient clearance for passage of the waste water tube.

20. An air gap body according to claim 11 wherein the upper housing is internally threaded for threaded mounting upon the central housing, and a portion of the tube support means is defined by a vertically oriented first slot in the upper housing for receiving the waste tube.

21. Air gap apparatus according to claim 11 and including a crimping fitting urging together the larger diameter tubing and the smaller diameter tubing and thereby constraining them against relative axial movement.

22. Air gap apparatus according to claim 21 wherein a plurality of successively smaller diameter counterbores are provided in the inlet port whereby one of a plurality of different diameter sections can be fitted into an appropriately sized one of the counterbores in operative association with a complementally sized quick connect fitting.

23. Air gap apparatus according to claim 11 and including a tubing adapter having a plurality of apertures and differently sized shank sections; a relatively small diameter waste water tube section extending downwardly and upwardly in serpentine orientation through the apertures, and downwardly through the shank sections; and a relatively large diameter waste water tube extending upwardly for fitting onto a complementally sized one of the shank sections, rendering it difficult to separate the waste water tube from the adapter.

* * * * *

UNITED STATES PATENT AND TRADEMARK OFFICE

CERTIFICATE OF CORRECTION

PATENT NO. : 6,453,931 B1
DATED : September 24, 2002
INVENTOR(S) : Paul L. Traylor It is certified that error appears in the above-identified patent and that said Letters Patent is hereby corrected as shown below:

Title page, Item [54 and Column 1, lines 1-2,
And wherever else occuring, the title should be corrected as follows:
-- COMBINATION DISHWASHER AND REVERSE OSMOSIS AIR GAP BODY --; and Column 6,
Line 64, delete "flow" and insert -- flows --.

Signed and Sealed this

Eleventh Day of February, 2003

JAMES E. ROGAN
*Director of the United States Patent and Trademark Office*